US007180449B2

(12) United States Patent
Liang et al.

(10) Patent No.: US 7,180,449 B2
(45) Date of Patent: Feb. 20, 2007

(54) ANTENNA WITH FILTER

(75) Inventors: Jia-Haur Liang, Kaohsiung (TW); Ting-Yi Tsai, Taipei (TW)

(73) Assignee: Accton Technology Corporation, Hsinchu (TW)

( * ) Notice: Subject to any disclaimer, the term of this patent is extended or adjusted under 35 U.S.C. 154(b) by 0 days.

(21) Appl. No.: 10/986,087

(22) Filed: Nov. 12, 2004

(65) Prior Publication Data

US 2006/0012526 A1 Jan. 19, 2006

(30) Foreign Application Priority Data

Jul. 13, 2004 (TW) ..... 93120836 A

(51) Int. Cl.
*H01Q 1/38* (2006.01)

(52) U.S. Cl. ..... 343/700 MS; 343/795; 343/850

(58) Field of Classification Search ..... 343/700 MS, 343/795, 850; 333/204
See application file for complete search history.

(56) References Cited

U.S. PATENT DOCUMENTS 3,707,681 A * 12/1972 Grant ..... 455/275
4,079,268 A * 3/1978 Fletcher et al. ..... 307/151
6,665,193 B1 * 12/2003 Chung et al. ..... 361/760

* cited by examiner

*Primary Examiner*—Michael C. Wimer
(74) *Attorney, Agent, or Firm*—Troxell Law Office, PLLC

(57) ABSTRACT

The present invention discloses an antenna with a filter, which comprises a substrate; an antenna device, a filter and a feed end. The antenna device is printed on the substrate; the filter is coupled to the antenna device; the feed end is coupled to the filter. The filter and the antenna device are radiating members printed on the substrate.

10 Claims, 10 Drawing Sheets

ANTENNA WITH FILTER

FIELD OF THE INVENTION

The present invention relates to an antenna, and more particularly, to an antenna having a filter produced by printing a metal conductive wire on a substrate for filtering unnecessary signals.

BACKGROUND OF THE INVENTION

As the wireless communications industry blooms, the fast development of wireless transmissions brings in various products and technologies that are used in multiple-frequency transmissions. Thus, many products are equipped with the wireless transmission capability to meet consumer requirements. In addition, it is very important for a wireless transmission product to have a good antenna.

In general, conventional antennas can receive or transmit a signal of a specific frequency band. When a wireless transmission product receives an external signal, theoretically the antenna only receives the signal of the specific frequency and will not receive signals of other frequency. However, conventional antennas will produce multi-frequency signals and other unnecessary signals while receiving signals, and thus will cause noises and interferences to the posterior circuits. A common method for filtering out those unnecessary multi-frequency signals is by adding a filter to the posterior circuit. Nevertheless, not only such method will increase the cost of the circuit, but also the additional filter will occupy some space that is a shortcoming for the trend of pursuing miniaturized wireless transmission products. Therefore, the present invention provides an antenna with a filter to overcome the foregoing shortcomings.

SUMMARY OF THE INVENTION

The primary objective of the invention is to provide an antenna capable of filtering out the multi-frequency signals.

The secondary objective of the invention is to provide an antenna without the requirement of adding a filter on the posterior circuit thereof for achieving the effect of lowering cost.

Another objective of the invention is to provide an antenna with a filter without the requirement of adding a filter on the posterior circuit thereof for achieving the effect of miniaturizing the same.

To achieve the foregoing objectives, the antenna of the present invention comprises a substrate, an antenna device, a filter and a feed end. The antenna device is arranged on the substrate, the filter is coupled to the antenna device, the feed end is coupled to the filter, and the antenna device and the filter are substantially metal conductive wires printed the substrate.

The present invention also provides an antenna, comprising: a first substrate, a second substrate, a first antenna device, a first filter, a second antenna device, a second filter, wherein the first substrate has a first top with the first antenna device arranged thereon and a first bottom, and the second substrate has a second top arranged corresponding to the first bottom of the first substrate and a second bottom with the second antenna device arranged thereon, and the first antenna device is coupled to the first filter and the second antenna device is coupled to the second filter, and both the first and the second antenna devices are substantially metal conductive wires printed the corresponding substrate.

To make it easier for our examiner to understand the objective of the invention, its structure, innovative features, and performance, we use a preferred embodiment including but not limited to the attached drawings for the detailed description of the invention.

DESCRIPTION OF THE PREFERRED EMBODIMENT

Figure 1A:
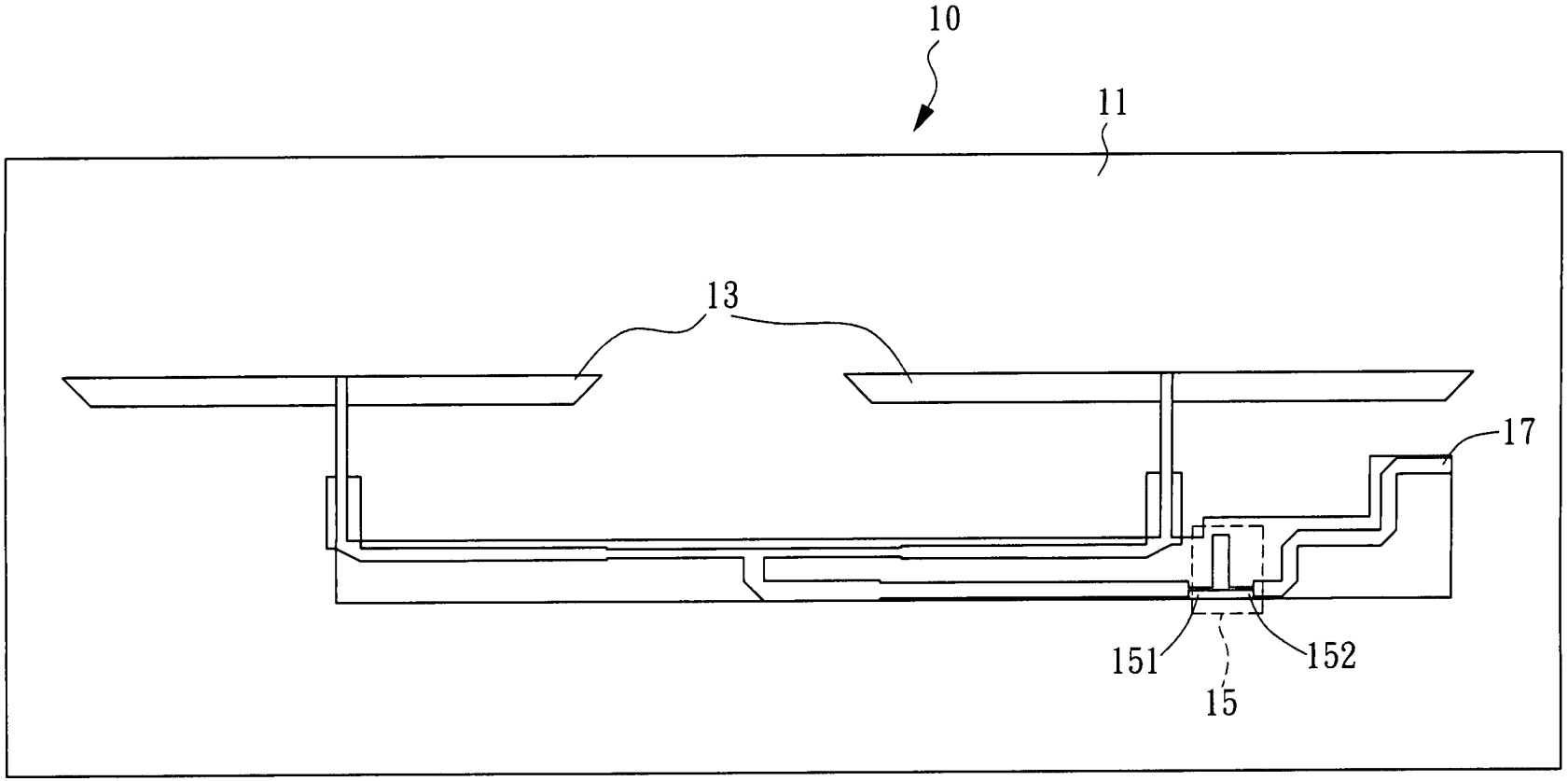
FIG. 1A is an illustrative view of the antenna according to a first preferred embodiment of the present invention.
Figure 1B:
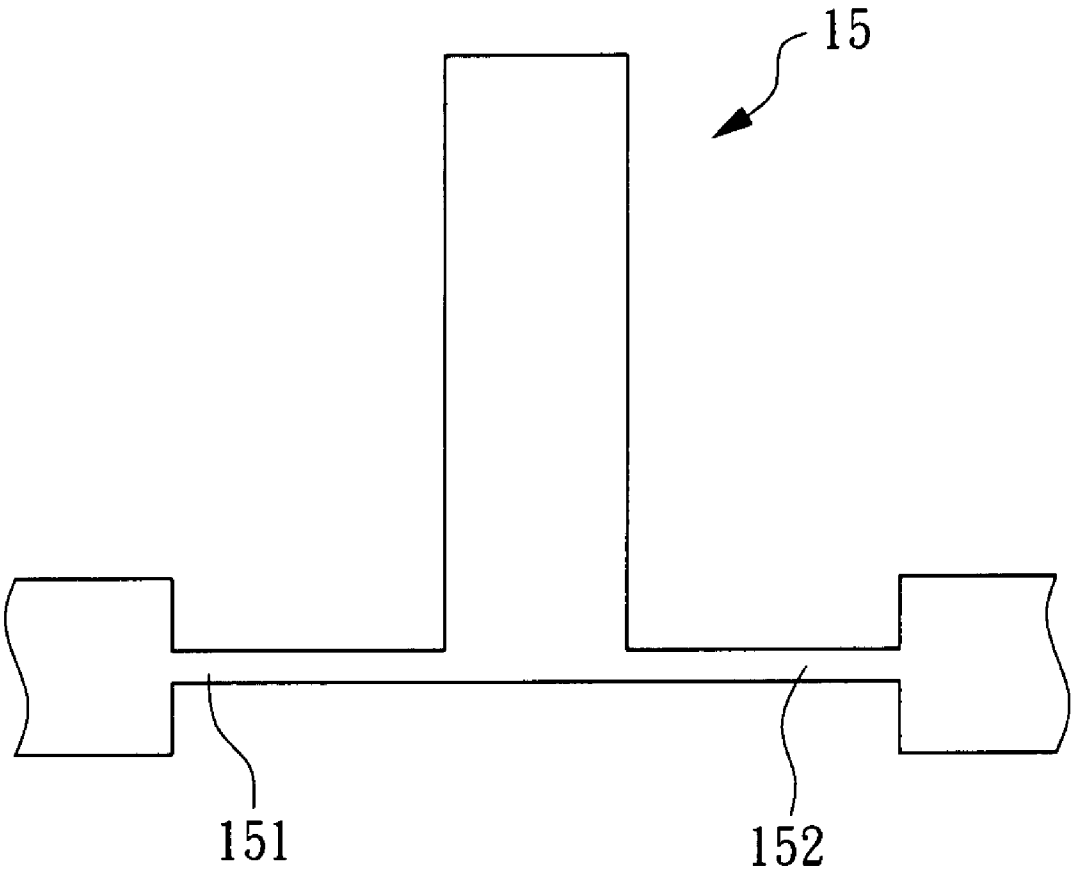
FIG. 1B is an illustrative view of the low-pass filter according to the preferred embodiment as depicted in FIG. 1A.

Please refer to FIGS. 1A and 1B for the illustrative views of the antenna with a filter and the filter according to a first preferred embodiment of the present invention respectively. The antenna 10 of the invention comprises a substrate 11, an antenna device 13, a low-pass filter 15 and a feed end 17. The substrate 11 is substantially either a printed circuit board made of fiberglass reinforced epoxy resin (FR4) or bismaleimide-triazine (BT), or a flexible film substrate made of polyimide. The antenna device 13 is substantially a radiating member printed on the substrate. The low-pass filter 15 has a first end 151 and a second end 152, where the first end 151 is coupled to the antenna device 13 and the second end 152 is coupled to the feed end 17.

In this preferred embodiment, the antenna device 13 is an antenna array, which is substantially a radiating member formed of a metal conductive wire printed on the substrate 11. The antenna device 13 is operated at one or more primary frequency bands (as required by the user) for receiving or transmitting signals of the primary frequency. For clarity, frequency band of 5.1~5.875 GHz is used as the primary frequency band hereinafter. Although only the antenna array is shown in FIG. 1A, the antenna device 13 could be a dipole antenna, a monopole antenna, a patch antenna, a planar inverted F antenna (PIFA), a circular polarized antenna (CP antenna) or any other antenna familiar to the persons skilled in the art.

The low-pass filter 15 is used for filtering out the signals other than those of the primary frequency. Since the metal conductive wire printed on the substrate 11 will produce a circuit component effect such as a capacitance and an inductance while operating at a high frequency, therefore the metal conductive wire is printed on the substrate 11 to form the low-pass filter 15 for filtering out the multi-frequency signals and preventing the posterior circuits from being interfered by the multi-frequency signals. The low-pass filter 15 has a long side and a short side, where a first end 151 and a second end 152 are extended from the short side. The first end 151 is coupled to the antenna device 13 and the second end 152 is coupled to the feed end 17. The length of the long side of the low-pass filter 15 is about 3~4 mm and the length of the short side of the low-pass filter 15 is about 1~1.5 mm. When the antenna device 13 receives a signal, the signal is sent to the feed end 17 and passes through the low-pass filter 15 to filter out the multi-frequency signals. Further, the area of the low-pass filter 15 can be adjusted according to the user's requirement enabling the signals of different frequencies to pass.

Figure 2A:
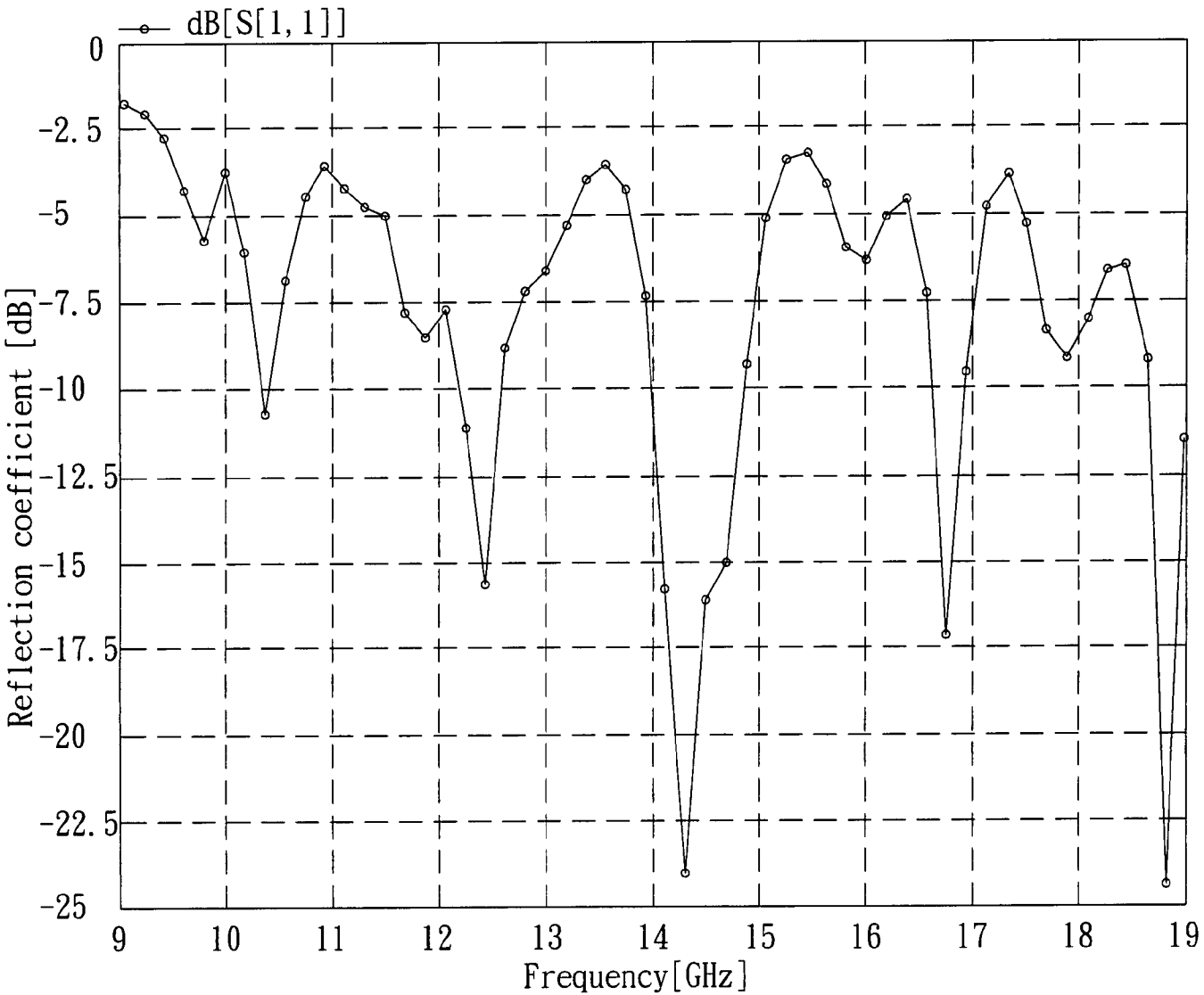
FIG. 2A is the measured result of the antenna without a filter according to the present invention.
Figure 2B:
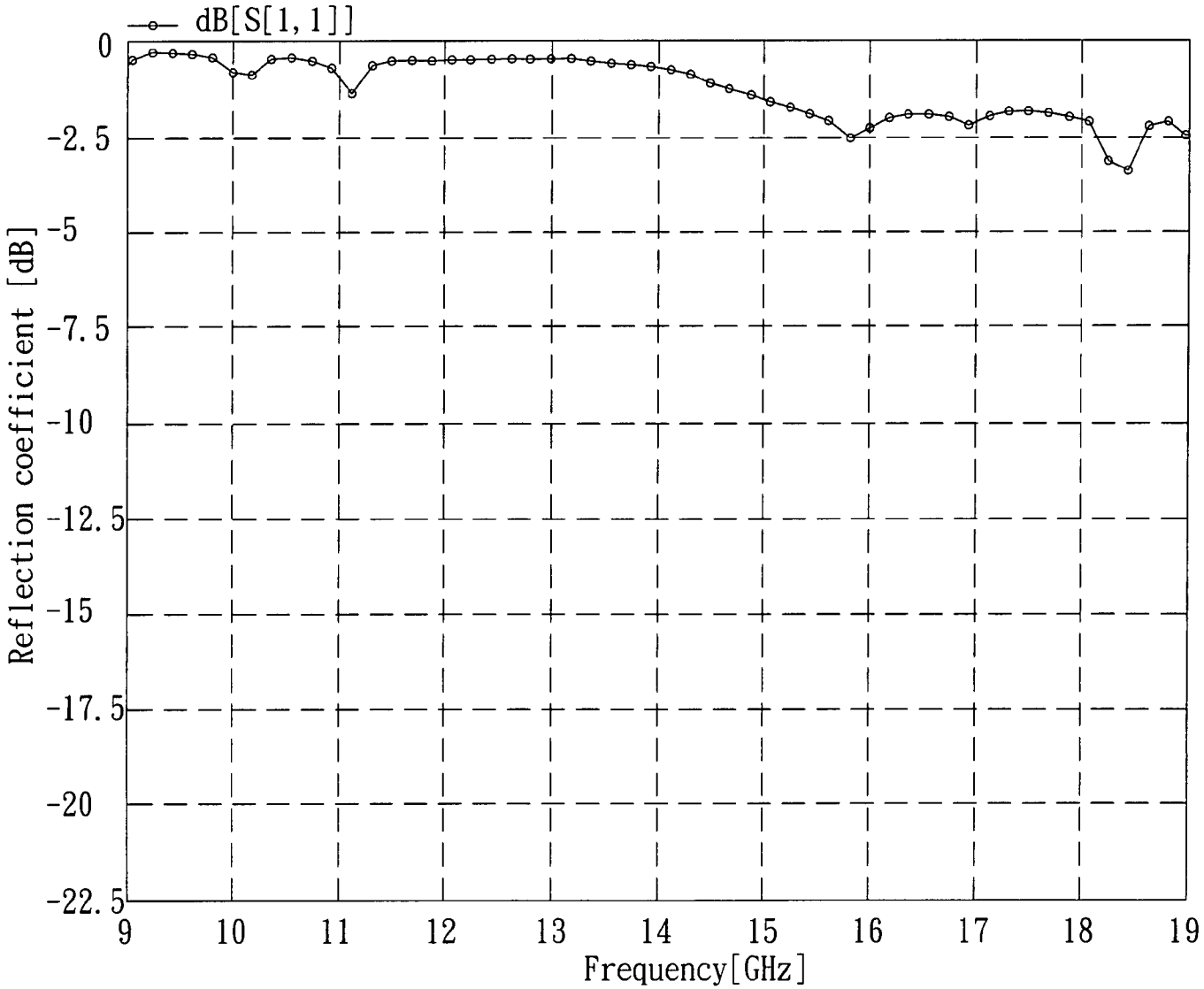
FIG. 2B is the measured result of the antenna with a filter according to the present invention.

Further, FIG. 1A shows the reflection coefficients S11 for the antenna 10 with or without the low-pass filter 15 and illustrates the difference of characteristics of the antenna 10 with and without the low-pass filter 15 respectively. When the antenna 10 as shown in FIG. 1A does not have the low-pass filter 15 and is operating at the primary frequency of 5.1~5.875 GHz, the measured reflection coefficients S11 of the antenna 10 for measuring the multi-frequency signal (for second harmonic or third harmonic) are all less than −3 dB as seen in FIG. 2A. On the other hand, when the antenna has a low-pass filter 15 and the antenna 10 is operated at the frequency range of 5.1~5.875 GHz, the measured reflection coefficients S11 of the antenna are larger than −3 dB while in the range of 9~19 GHz as seen in FIG. 2B. Such measurements show that the antenna 10 of the low-pass filter 15 has a better effect on filtering out frequency multiply interference.

Figure 3A:
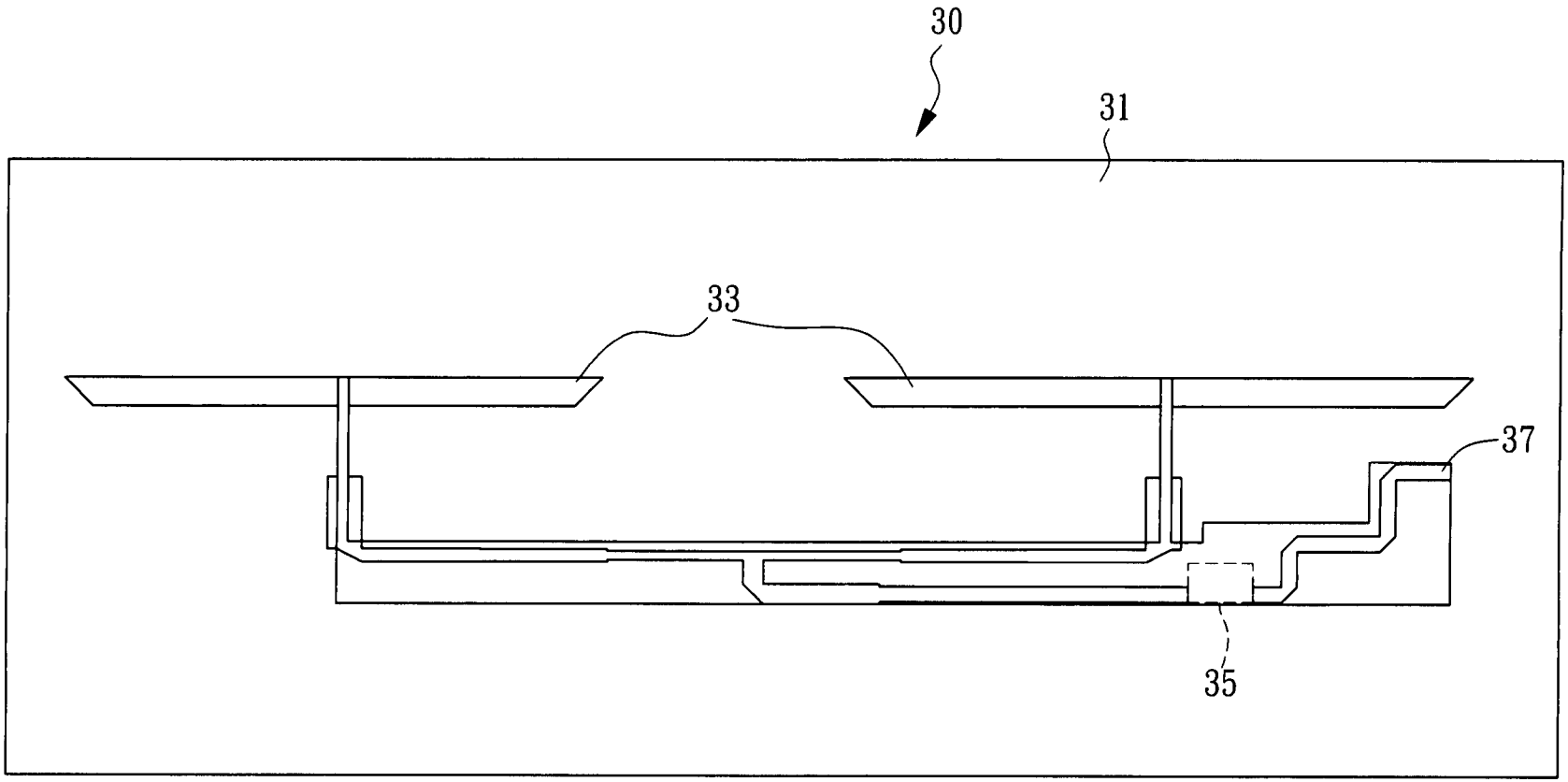
FIG. 3A is an illustrative view of the antenna according to a second preferred embodiment of the present invention.
Figure 3B:
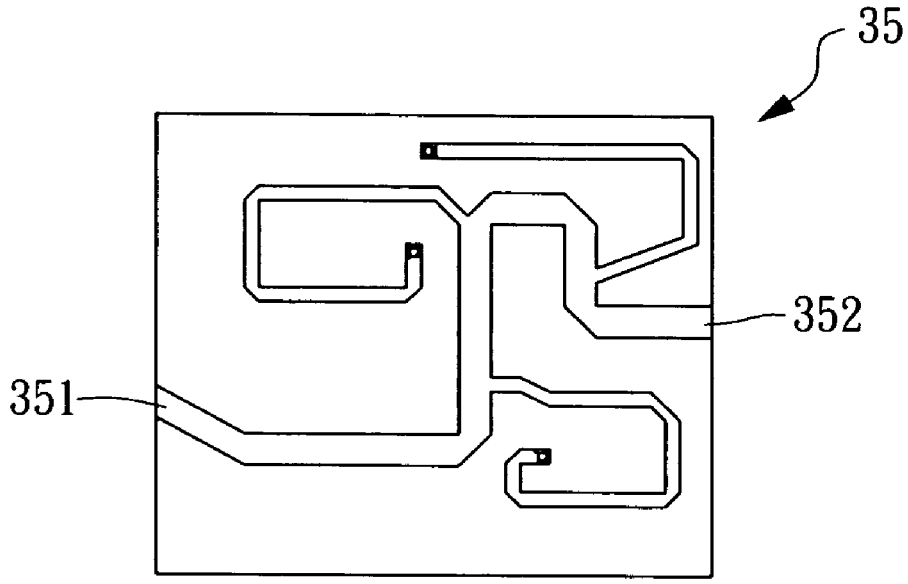
FIG. 3B is an illustrative view of the band-pass filter according to the preferred embodiment as depicted in FIG. 3A.
Figure 3C:
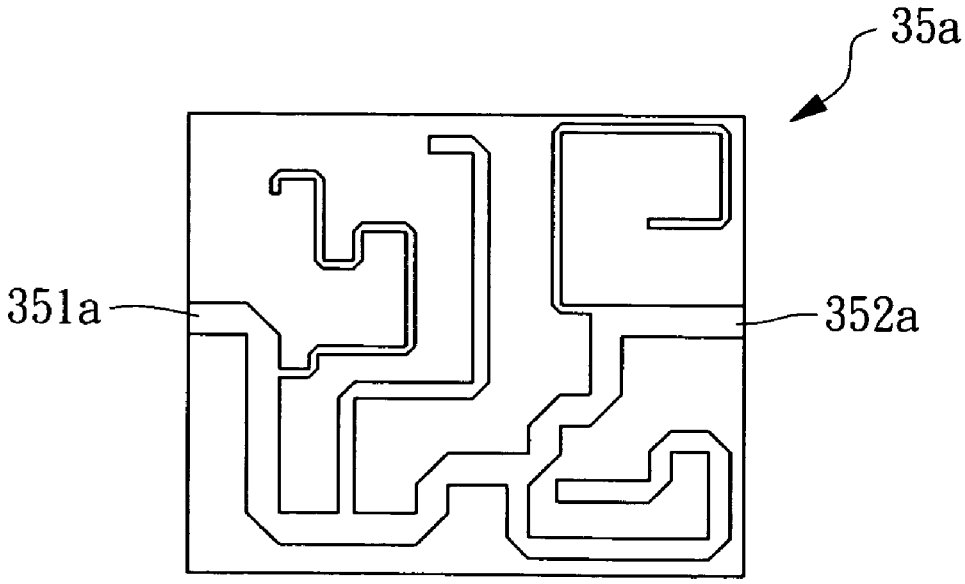
FIG. 3C is another view the band-pass filter according to the preferred embodiment as depicted in FIG. 3A.

Please refer to FIG. 3A for the antenna according to the second preferred embodiment of the present invention. The antenna 30 comprises a substrate 31, an antenna device 33, a band-pass filter 35 and a feed end 37. The antenna device 33 is an antenna array which is substantially two planar antennas printed on the substrate 31. The antenna device 33 can be operated at one or more primary frequency band for receiving or transmitting signals of the primary frequency. The band-pass filter 35 only allows the signals of the primary frequency to pass, and the primary frequency can be selected according to the user's requirement. FIG. 3B shows a band-pass filter 35 according to a first embodiment of the present invention. The band-pass filter 35 is a radiating element printed on the substrate 31 for allowing only the signals of the primary frequency to pass and filtering out other signals. The band-pass filter 35 has a first end 351 and a second end 352, and the first end 351 is connected to the antenna device 33 and the second end 352 is connected to the feed end 37. Further, the band-pass filter 35*a* could also be in the mode as shown in FIG. 3C, and such band-pass filter 35*a* has a first end 351*a* and a second end 352*a*. The first end 351*a* is used to connect the antenna device 33 and the second end is connected to the feed end 37.

Figure 4:
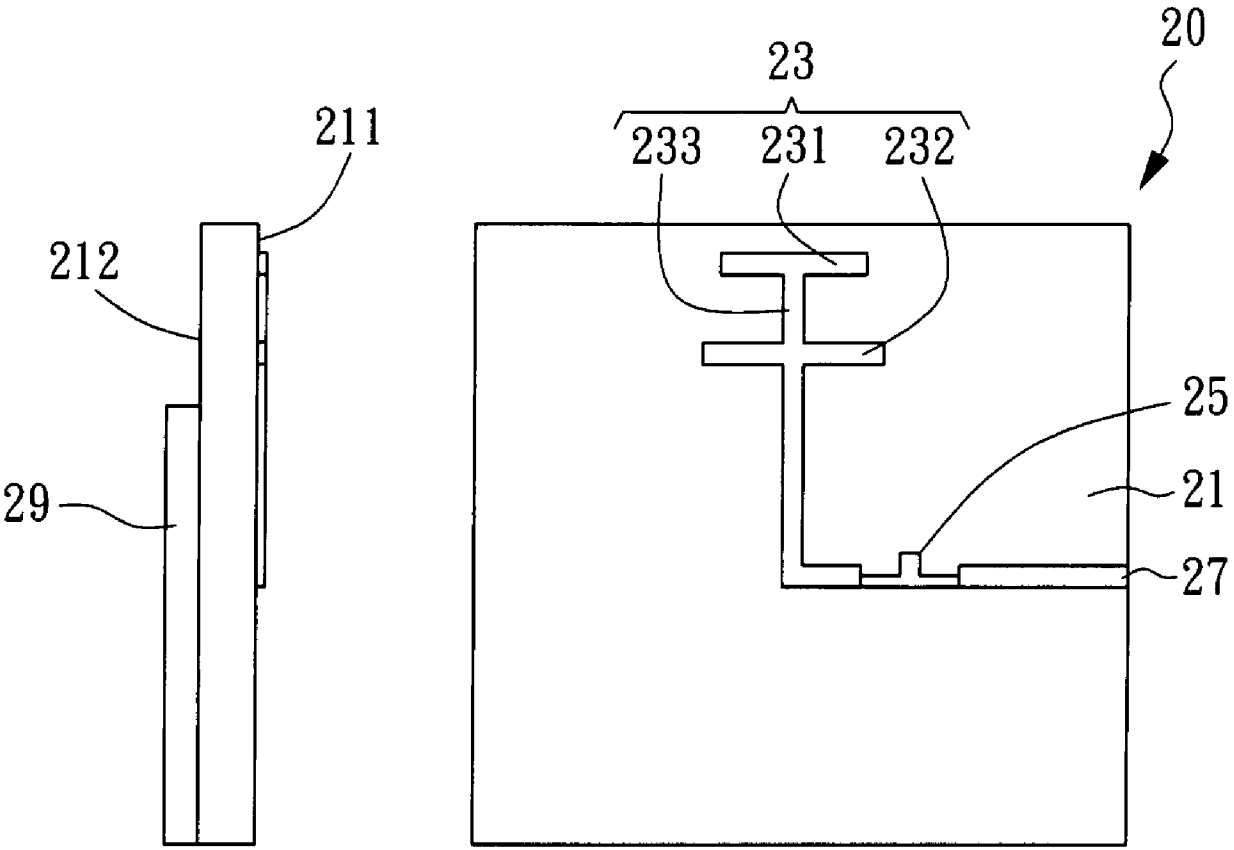
FIG. 4 is an illustrative view of the antenna according to a third preferred embodiment of the present invention.

Please refer to FIG. 4 for the antenna according to the third embodiment of the present invention. The antenna 20 comprises a substrate 21, a dual-frequency monopole antenna 23, a low-pass filter 25 and a feed end 27. The substrate 21 has a first surface 211 and a second surface 212. The substrate 21 is substantially either a printed circuit board made of fiberglass reinforced epoxy resin (FR4) or bismaleimide-triazine (BT), or a flexible film substrate made of polyimide. The dual-frequency monopole antenna 23 comprisies a first horizontal radiating conductive wire 231, a second horizontal radiating conductive wire 232, and a first vertical radiating conductive wire 233, wherein all the radiating conductive wires are printed on the first surface 211, and the first vertical radiating conductive wire 233 is disposed perpendicular to the first and second horizontal radiating conductive wires 231, 232 at a position precisely in the middle of the first and second horizontal radiating conductive wires 231, 232. One end of the low-pass filter 25 is connected to the first vertical radiating conductive wire 233 and the other end of the low-pass filter 25 is connected to the feed end 27. The feed end 27 is used for transmitting signals and the low-pass filter 25 is used for filtering out unnecessary signals. Besides, a grounding surface 29 is printed on a second surface 212. The first horizontal radiating conductive wire 231 is substantially a first resonance path, and the second horizontal radiating conductive wire 232 is substantially a second resonance path. The first and second horizontal radiating conductive wires 231, 232 are operated at a first frequency band and a second frequency band respectively. The lengths of the first and second horizontal radiating conductive wires 231, 232 are determined basing on the operating frequency band. For example, if the first frequency band is 2.2~2.7 GHz and the second frequency band is 5.1~5.875 GHz, then the length of the first horizontal radiating conductive wire 231 is approximately 12~14 mm, and the length of the second horizontal radiating conductive wire 232 is approximately 16~18 mm. The low-pass filter 25 is used to filter the frequency multiplication of the first frequency and the second frequency. The low-pass filter 25 is as that shown in FIG. 1B which will not be described hereinafter.

Figure 5A:
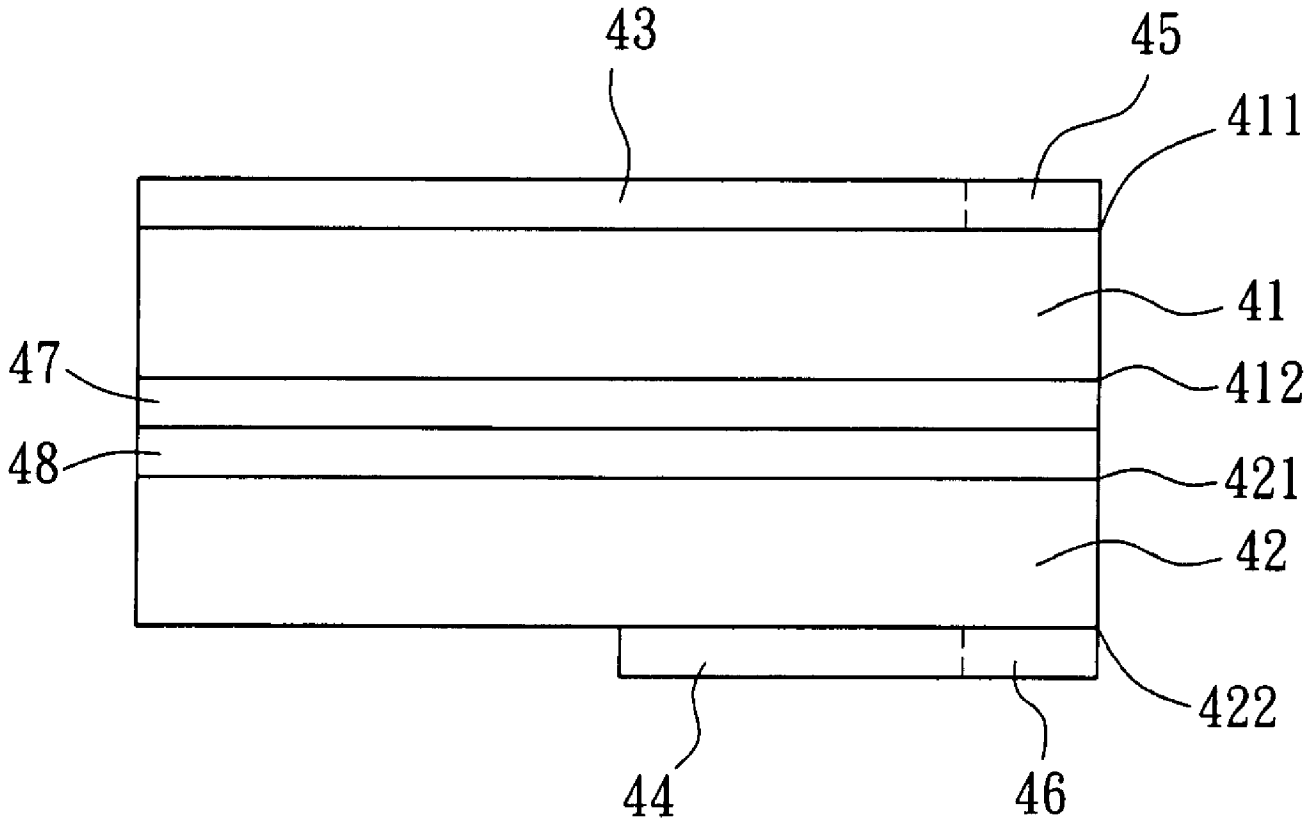
FIG. 5A is a side view of the antenna according to a fourth preferred embodiment of the present invention.
Figure 5B:
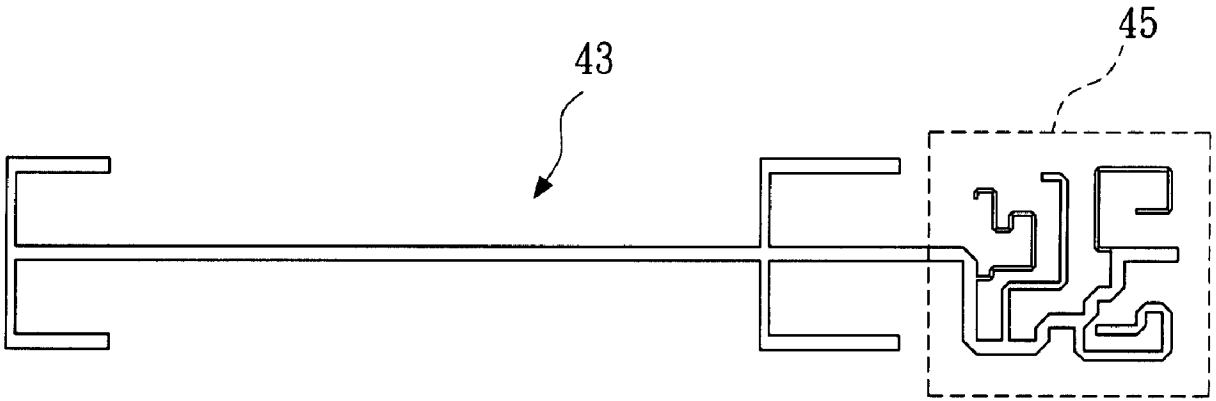
FIG. 5B is a top plan view of the antenna according to a fourth preferred embodiment of the present invention.
Figure 5C:
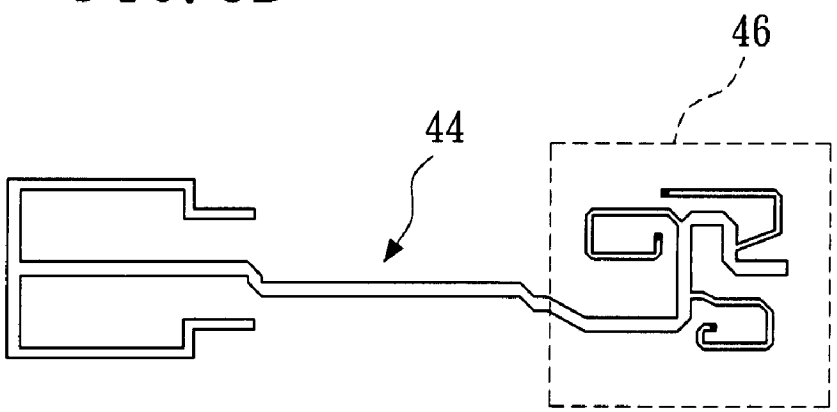
FIG. 5C is a bottom plan view of the antenna according to a fourth preferred embodiment of the present invention.
Figure 5D:
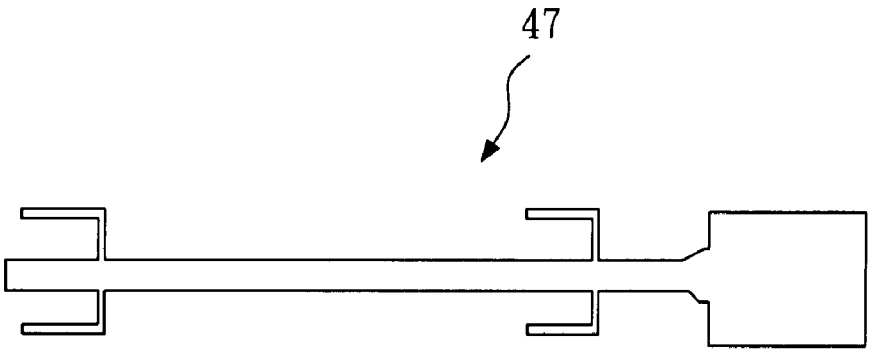
FIG. 5D is a diagram showing a first grounding of the present invention.
Figure 5E:
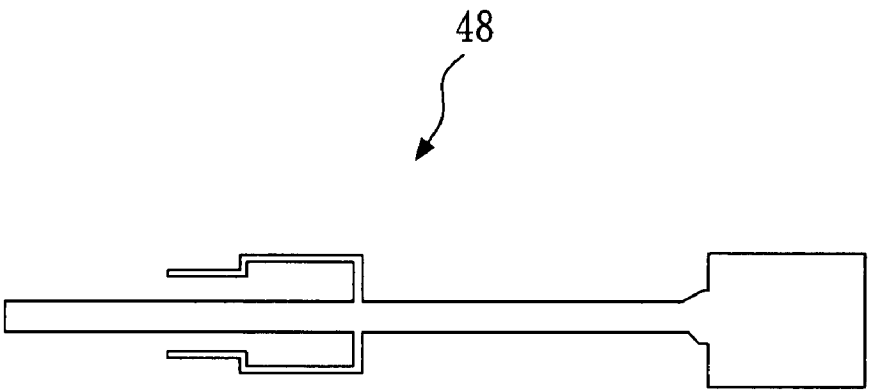
FIG. 5E is a diagram showing a second grounding of the present invention.

Please refer to FIG. 5A~FIG. 5E, which are diagrams showing a fourth preferred embodiment of the invention. The antenna 40 comprises: a first substrate 41, a second substrate 42, a first antenna device 43, a first filter 45, a second antenna device 44, a second filter 46, a first grounding surface 47 and a second grounding surface 48. Both the first substrate 41 and the second substrate 42 are substantially either printed circuit board made of fiberglass reinforced epoxy resin (FR4) or bismaleimide-triazine (BT), or a flexible film substrates made of polyimide. The first substrate 41 has a first top 411 with the first antenna device 43 arranged thereon and a first bottom 412. The second substrate 42 has a second top 421 arranged corresponding to the first bottom 412 of the first substrate 41 and a second bottom 422 with the second antenna device 44 arranged thereon. In addition, the first grounding surface 47 is arranged on the first bottom 412 and the second grounding surface 48 is arranged on the second top 421 by which the size of the first grounding surface 47 of FIG. 5D is corresponding to the size of the first antenna device 43, and the size of the second grounding surface 48 of FIG. 5E is corresponding to the size of the second antenna device 44. By superimposing the second top 421 with the first bottom 412 which are glued together by a glue, an double-layer antenna is formed. The first antenna device 43 is coupled to the first filter 45 and the second antenna device 44 is coupled to the second filter 46, and both the first and the second antenna devices are substantially microstrip antennas respectively printed the first top 411 of the first substrate.

In the preferred embodiment, the first antenna device 43 is operating at frequency of 5.1~5.875 GHz for receiving and transmitting signals of frequency between 5.1~5.875

GHz, and uses the first filter 45 as band-pass filter for allowing signal of a first frequency to pass and filtering out other signals, such as signals of frequency between 2.1~2.7 GHz in the preferred embodiment. The second antenna device 44 is operating at frequency of 2.1~2.7 GHz for receiving and transmitting signals of frequency between 2.1~2.7 GHz, and uses the first filter 46 as band-pass filter for allowing signal of a second frequency to pass and filtering out other signals, such as signals of frequency between 5.1~5.875 GHz in the preferred embodiment. In this regard, the isolation between the first antenna device 43 and the second antenna device 44 is enhanced for avoiding interference between the two.

In view of the method describe above, it is obvious that a printed antenna with additional filter added on the radiating member thereof can filter out unnecessary signals to facilitate the operation of the posterior circuits and waive the additional filter needed for the posterior circuits. Therefore, the antenna with a filter according to the present invention has the following advantages:

1. The invention can filter out frequency multiply signals and prevent the posterior circuits from interference of frequency multiplication.
2. The invention can do without a filter coupled to the posterior circuits such that cost can be reduced.
3. The invention can do without a filter coupled to the posterior circuits such that the effect of miniaturization can be achieved.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. An antenna, comprising:

a first substrate, having a first top and a first bottom;

a second substrate, having a second top arranged corresponding to said first bottom and a second bottom;

a first antenna device, being disposed on said first top;

a first filter device, coupled to said first antenna device;

a second antenna device, being disposed on said second bottom; and a second filter, coupled to said second antenna device;

wherein, the first antenna device and the second antenna device are substantially radiating members printed on said corresponding substrates.

2. The antenna of claim 1, wherein a first grounding surface is arranged on said first bottom, and a second grounding surface is arranged on said second top.

3. The antenna of claim 1, wherein said first filter and said second are low-pass filters.

4. The antenna of claim 1, wherein said first filter and said second are band-pass filters.

5. The antenna of claim 1, wherein said first antenna device and second antenna device are respectively one selected from the group consisting of a dipole antenna, a monopole antenna, a patch antenna, an planar inverted F antenna (PIFA), and a circular polarized antenna (CP antenna).

6. The antenna of claim 1, wherein said first and said second antenna devices are antenna arrays.

7. The antenna of claim 1, wherein said first substrate and second substrate are respectively a printed circuit board made of fiberglass reinforced epoxy resin (FR4).

8. The antenna of claim 1, wherein said substrate is a flexible film substrate made of polyimide.

9. The antenna of claim 1, wherein said first substrate and second substrate are respectively a printed circuit board made of bismaleimide-triazine (BT).

10. The antenna of claim 1, wherein said antenna device and filter are metal conductive wires printed on said corresponding substrate.

* * * * *